US007251858B2

(12) United States Patent
Hitzelberger et al.

(10) Patent No.: US 7,251,858 B2
(45) Date of Patent: Aug. 7, 2007

(54) FLOOR CARE APPARATUS WITH MULTIPLE AGITATOR SPEEDS AND CONSTANT SUCTION POWER

(75) Inventors: J. Erik Hitzelberger, Danville, KY (US); George N. Woolcott, Lancaster, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 602 days.

(21) Appl. No.: 10/764,401

(22) Filed: Jan. 23, 2004

(65) Prior Publication Data

US 2005/0160556 A1 Jul. 28, 2005

(51) Int. Cl.
*A47L 9/04* (2006.01)

(52) U.S. Cl. ..... 15/389; 15/384; 15/377

(58) Field of Classification Search ..... 15/384, 15/389, 377, 319
See application file for complete search history.

(56) References Cited

U.S. PATENT DOCUMENTS

| | | | | |
|---|---|---|---|---|
| 3,579,706 | A | 5/1971 | Hetland | |
| 3,588,946 | A | 6/1971 | Hetland | |
| 4,370,777 | A | 2/1983 | Woerwag | |
| 4,399,585 | A | 8/1983 | Kullik et al. | |
| 4,447,930 | A | 5/1984 | Glenn, III et al. | |
| 4,457,042 | A | 7/1984 | Jones et al. | |
| 4,611,365 | A | 9/1986 | Komatsu et al. | |
| 4,654,924 | A | 4/1987 | Getz et al. | |
| 4,654,927 | A * | 4/1987 | Novinger | 15/384 |
| 4,880,474 | A | 11/1989 | Koharagi et al. | |
| 4,953,253 | A | 9/1990 | Fukuda et al. | |
| 4,958,406 | A | 9/1990 | Toyoshima et al. | |
| 5,144,715 | A | 9/1992 | Matsuyo et al. | |
| RE34,286 | E | 6/1993 | Toyoshima et al. | |
| 5,243,732 | A | 9/1993 | Koharagi et al. | |
| 5,255,409 | A | 10/1993 | Fujiwara et al. | |
| 5,276,939 | A | 1/1994 | Uenishi | |
| 5,381,584 | A | 1/1995 | Jyoraku et al. | |
| 5,463,299 | A | 10/1995 | Futami et al. | |
| 5,507,067 | A | 4/1996 | Hoekstra et al. | |
| 5,515,572 | A | 5/1996 | Hoekstra et al. | |
| 5,554,917 | A | 9/1996 | Kurz et al. | |
| 5,722,109 | A | 3/1998 | Delmas et al. | |
| 5,881,430 | A | 3/1999 | Driessen et al. | |
| 6,008,608 | A | 12/1999 | Holsten et al. | |
| 6,301,743 | B1 | 10/2001 | Cloud, III et al. | |
| 6,400,048 | B1 | 6/2002 | Nishimura et al. | |
| 6,446,302 | B1 | 9/2002 | Kasper et al. | |

(Continued)

*Primary Examiner*—Theresa T. Snider
(74) *Attorney, Agent, or Firm*—King & Schickli PLLC

(57) ABSTRACT

A floor care apparatus has a nozzle assembly housing an agitator. A motor couples to the agitator to drive it at two or more speeds and constant suction power. A user indicates their mode-of-operation preference by positioning a switch. An agitator motor control circuit, responsive to the switch, effectuates motor control by supplying either a fixed duty cycle signal or a substantially constant voltage signal. The fixed duty cycle signal includes a waveform with a substantially constant voltage value that is on for a first or first and second of four quarters of the waveform period. Thereafter, it repeats for additional periods. The switch preferably embodies a resistor network and a fixed current source that creates a voltage input to an A/D converter that falls within a specified range. Other apparatus embodiments contemplate multiple agitators with one or more agitator motors. A suction fan motor, separate from the agitator motor(s), may also exist.

26 Claims, 10 Drawing Sheets

U.S. PATENT DOCUMENTS

| | | | |
|---|---|---|---|
| 6,457,205 | B1 | 10/2002 | Conrad |
| 6,479,956 | B1 | 11/2002 | Kawabata et al. |
| 6,490,752 | B2 | 12/2002 | Kushida et al. |
| 6,526,622 | B2 | 3/2003 | Conrad |
| 6,545,443 | B2 | 4/2003 | Kushida |
| 2001/0028239 | A1 | 10/2001 | Vanderhenst |
| 2002/0056169 | A1 | 5/2002 | Kushida et al. |
| 2002/0057069 | A1 | 5/2002 | Kushida |
| 2002/0112315 | A1 | 8/2002 | Conrad |
| 2002/0175646 | A1 | 11/2002 | Kushida et al. |
| 2002/0185987 | A1 | 12/2002 | Kushida et al. |
| 2004/0134014 | A1* | 7/2004 | Hawkins et al. ..... 15/389 |

* cited by examiner

FLOOR CARE APPARATUS WITH MULTIPLE AGITATOR SPEEDS AND CONSTANT SUCTION POWER

TECHNICAL FIELD

The present invention relates generally to the floor care field. More particularly, it relates to a floor care apparatus, such as a canister or upright vacuum cleaner, having an agitator driven with a plurality of operating speeds and no corresponding loss of power.

BACKGROUND OF THE INVENTION

Whether canister or upright, vacuum cleaners in all of their designs and permutations have become increasingly popular over the years. In general, vacuum cleaners incorporate a suction fan motor, attendant dirt cup or filter bag and a nozzle assembly fluidly and mechanically connected thereto that sucks up dirt and dust by operator movement across a dirt-laden floor. Specifically, an agitator within the nozzle assembly rotates to beat the nap of a carpet and dislodge dirt and dust during a time when an operator manipulates the cleaner back and forth. Problematically, when operators clean bare-floors or BERBER style carpets, for example, agitators rotating at full speed can sometimes cause damage. Thus, some attempts in the prior art have reduced the speed of the suction fan motor to cause a corresponding reduction in the speed of the agitator. With this, however, comes a corresponding loss in suction and loss of cleaning ability.

Accordingly, the floor care arts have need of an agitator that can rotate without damaging certain floor or carpet types while still providing effective cleaning.

SUMMARY OF THE INVENTION

In accordance with the purposes of the present invention as described herein, an improved floor care apparatus is provided. The apparatus may take the form of a canister or an upright vacuum cleaner or may embody an extraction cleaning device or other hereinafter developed product having an agitator.

In one embodiment, the floor care apparatus has a nozzle assembly housing an agitator. A motor couples to the agitator to drive it at two or more speeds while a user indicates their mode-of-operation preference, in turn indicating a speed preference, by positioning a switch. An agitator motor control circuit, responsive to the switch, effectuates motor control by supplying either a fixed duty cycle signal or a substantially constant voltage signal to the motor. In one aspect, the fixed duty cycle is about 0.25 corresponding to a rectangular waveform with a substantially constant voltage value that is on for a first of four quarters of the waveform period. Thereafter, the waveform repeats for additional periods. In this manner, if the line voltage is 120 Vac, the agitator motor receives an average voltage value (in a dc equivalent downstream of a bridge rectifier) of 0.25×120 or about 30 V. In another aspect, the fixed duty cycle is about 0.5 corresponding to a rectangular waveform with a substantially constant voltage value that is on for a first two quarters of four quarters of the waveform period. Thereafter, the waveform repeats for additional periods. When the signal is a constant voltage value signal, the agitator motor control circuit produces an agitator motor voltage corresponding to about 100% of the line voltage (again the agitator motor receives this as a dc equivalent downstream of a bridge rectifier). As a result, the agitator is either run at 100% of the line voltage or at about 25% or 50% of the line voltage to enhance cleaning on various style floors. During 100% of line voltage, or full speed, the agitator rotates at about 3000 to about 6000 rpm. During other times, it rotates at about 800 to about 2000 rpm.

One agitator motor control circuit utilizes a bridge rectifier, a timer circuit and a MOSFET as a transistor switch. An output of the timer turns the gate of the MOSFET on or off thereby pulsing, or not, the agitator motor tied between a power source and the MOSFET source. The bridge rectifier transforms the line voltage into a dc voltage which serves as the power source.

A preferred multi-position user operated switch includes a resistor network and a fixed current source that creates a voltage input to an A/D converter that falls within a specified voltage range set by the A/D manufacturer.

In other embodiments, cleaners have multiple agitators with one or more agitator motors controlling the speed thereof. Some embodiments include rotating or running two agitators with the same speed, in the same direction; same speed, different directions; different speeds, same direction; or different speeds, different directions. A suction fan motor, $M_{FAN}$, separate from the agitator motor(s), $M_{AG}$, may also exist in the cleaner. Agitator motors may reside, or not, within an interior of the agitator.

In the following description there is shown and described possible embodiments of the invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serves to explain the principles of the invention. In the drawings.

Reference will now be made in detail to the present invention, an example of which is illustrated in the accompanying drawings.

DETAILED DESCRIPTION OF THE INVENTION

Figure 1:
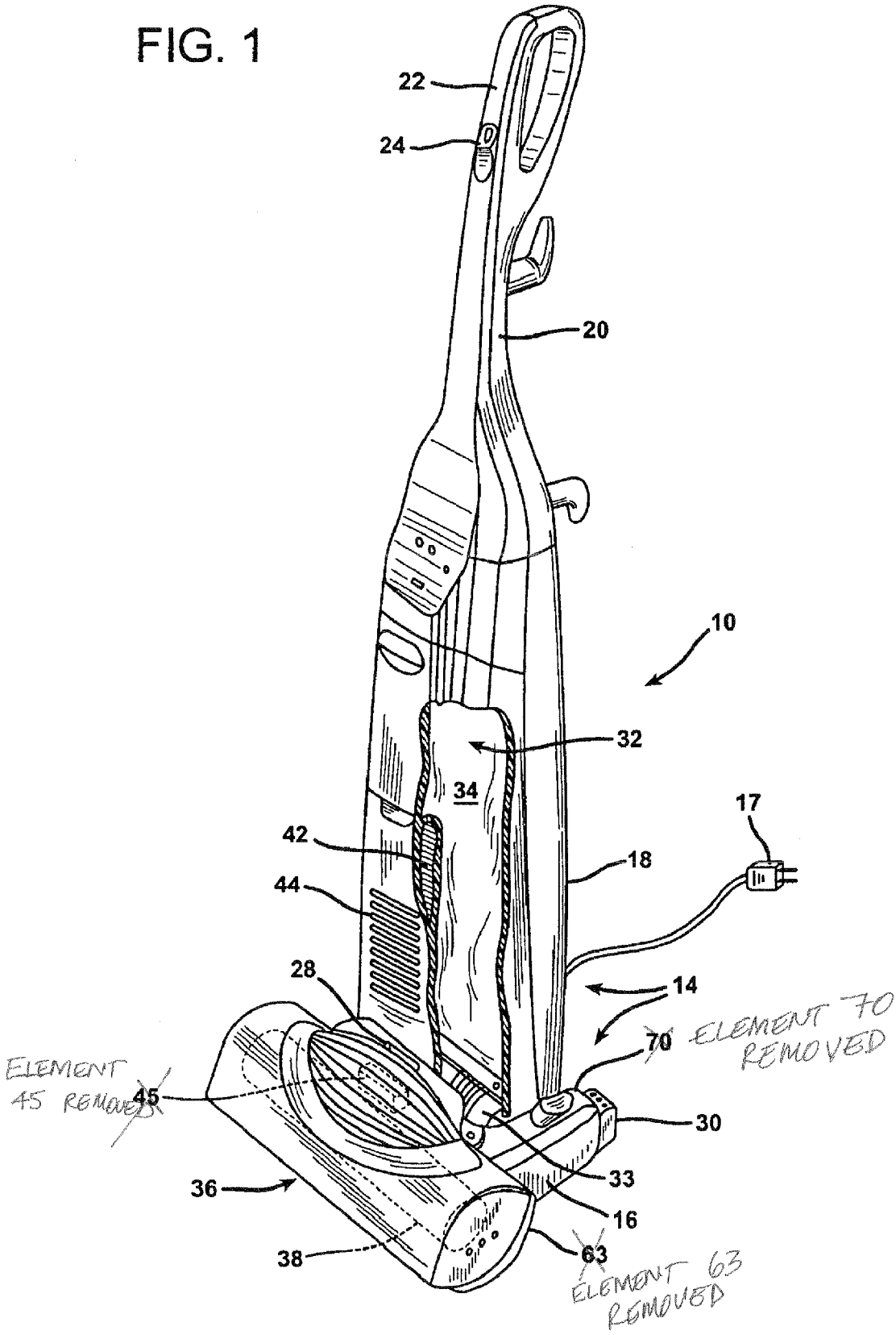
FIG. 1 is a perspective view of a floor care apparatus, in this instance an upright vacuum cleaner, constructed in accordance with the teachings of the present invention.

Reference is now made to FIG. 1 showing a floor care apparatus of the present invention. The apparatus illustrated exemplifies an upright vacuum cleaner 10 comprised generally of a housing 14 that comprises the nozzle assembly 16 and the canister assembly 18. The canister assembly 18 further includes the handle 20 and the hand grip 22. The hand grip 22 carries a control switch 24 for turning the vacuum cleaner 10 on and off and to indicate a user mode-of-operation preference, thereby indicating a preference of agitator speed, as will be described below. Of course, electrical power is supplied to the vacuum cleaner 10 from a standard electrical wall outlet through a cord and plug assembly 17. At the lower portion of the canister assembly 18, rear wheels (not shown) are provided to support the weight of the vacuum cleaner 10. A second set of wheels (not shown) allow the operator to raise and lower the nozzle assembly 16 through selective manipulation of the height adjustment switch 28. Such a height adjustment mechanism is shown and described in detail in U.S. Pat. No. 5,467,502 to Johnson et al. and owned by the assignee of the present invention. The full disclosure in this patent is incorporated herein by reference. To allow for convenient storage of the vacuum cleaner 10, a foot latch 30 functions to lock the canister assembly 18 in an upright position, as shown in FIG. 1. When the foot latch 30 is released, the canister assembly 18 may be pivoted relative to the nozzle assembly 16 as the vacuum cleaner 10 is manipulated to clean the floor.

The canister assembly 18 also carries an internal chamber 32 that houses a suction fan motor 33 (i.e. a state of the art fan and motor combination) and a dust bag 34 for removing dirt or dust entrained in the air stream as it passes in an airflow path from the nozzle assembly 16 to the suction fan motor. During use, the suction fan motor 33 creates the suction airflow in a well known manner. Alternatively, manufacturers may substitute a filter-less dirt cup, cyclonic dirt cup or other, for the dust bag. The canister assembly 18 may also carry a final filtration cartridge 42 to trap small particulates and prevent their reintroduction into the environment through the exhaust port 44.

Figure 11:
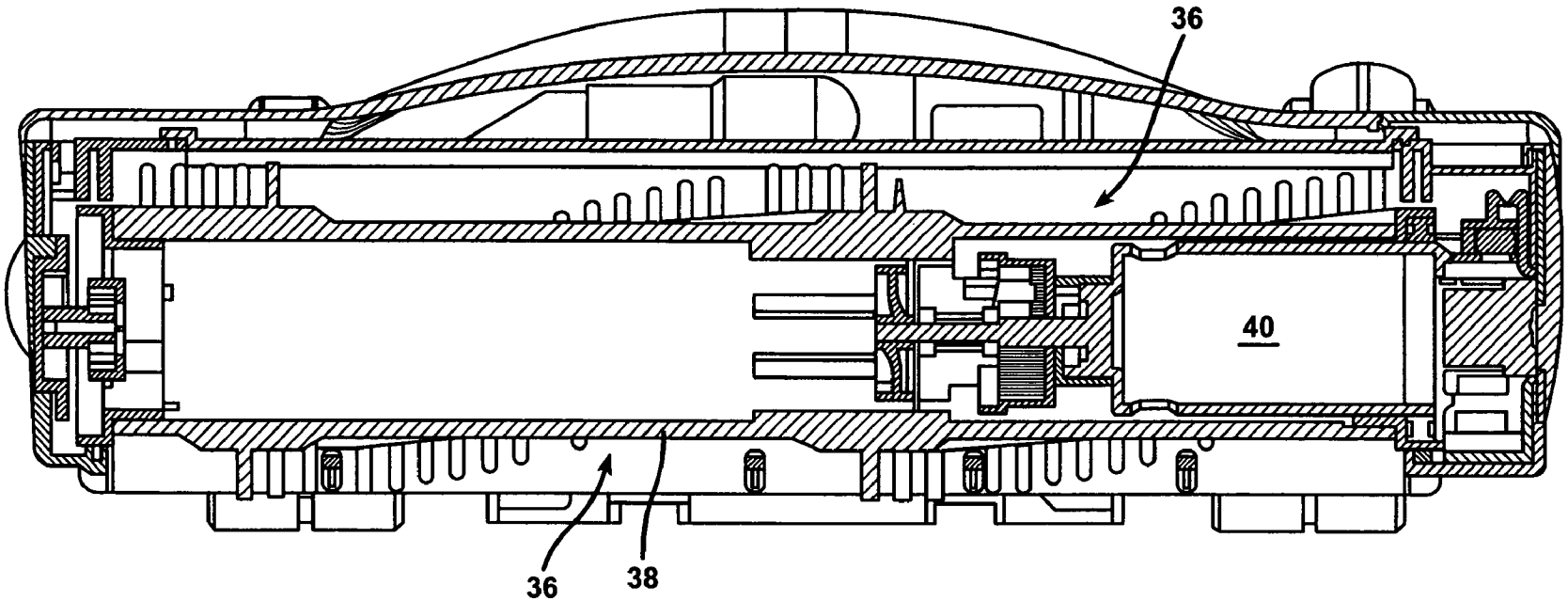
FIG. 11 is a cross-sectional view of an agitator, in accordance with the present invention, housing an agitator motor.
Figure 1:
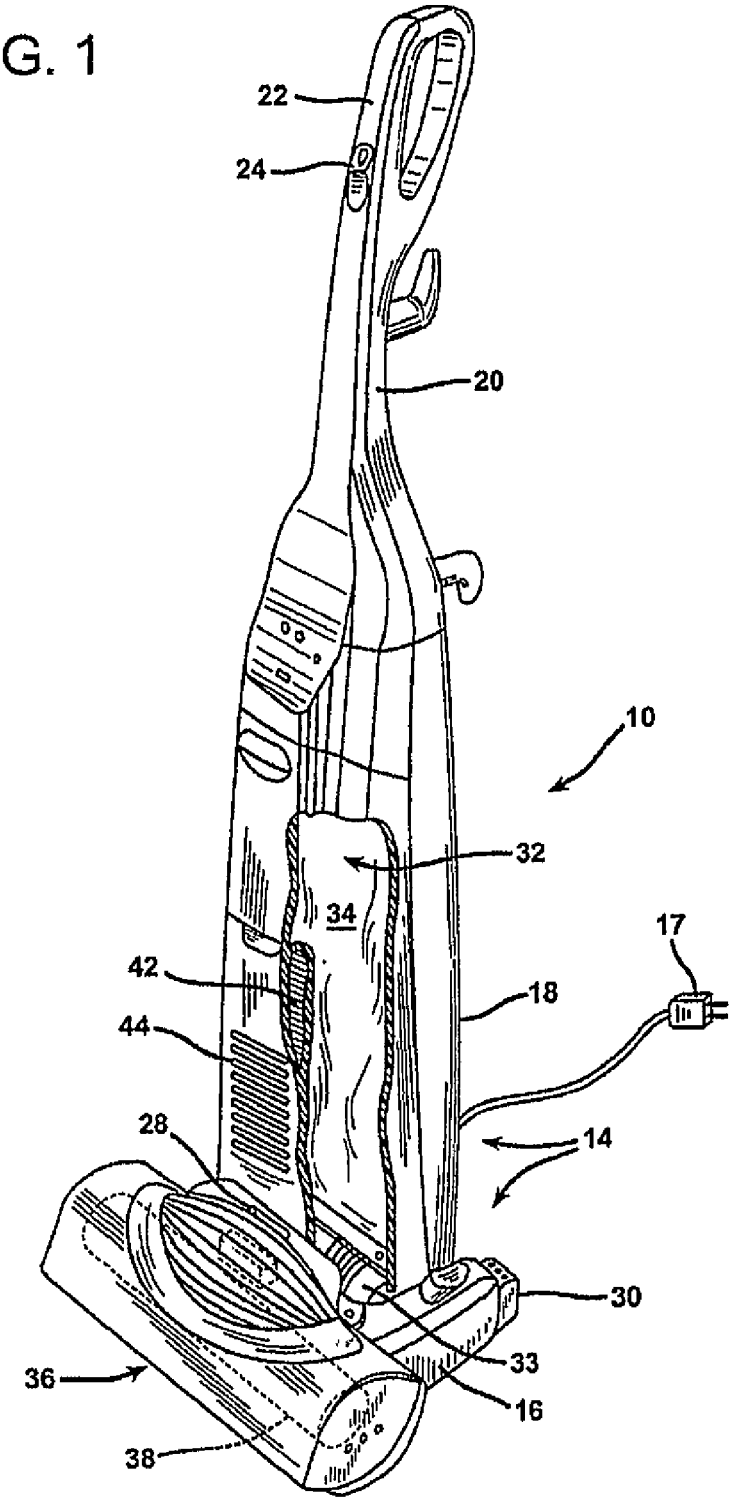

The nozzle assembly 16 includes a nozzle and agitator cavity 36 that houses an agitator 38. The agitator 38 shown is rotatably driven by a motor 40 and cooperating gear drive housed within the agitator (see FIG. 11). Such an arrangement is described in greater detail in co-pending U.S. patent application Ser. No. 10/380,604 filed Sep. 10, 2003 entitled Airflow System for Bagless Vacuum Cleaner (which is a 371 of PCT/US01/30910 filed Oct. 3, 2001 which claims priority from provisional application Ser. No. 60/237,832 filed Oct. 3, 2000), the full disclosure of which is incorporated herein by reference. In the illustrated vacuum cleaner 10, the scrubbing action of the rotary agitator brush 38 and the negative air pressure created by the suction fan motor 33 cooperate to brush and beat dirt and dust from the nap of the carpet being cleaned and then draw the dirt and dust laden air from the agitator cavity 36 to the dust bag 34. Specifically, the dirt and dust laden air passes serially through a suction inlet and hose (not shown) and/or an integrally molded conduit in the nozzle assembly 16 and/or canister assembly 18 as is known in the art. Next, it is delivered into the chamber 32 and passes through the porous walls of the dust bag 34. The bag 34 serves to trap the suspended dirt, dust and other particles inside while allowing the now clean air to pass freely through the wall thereof and then through the suction fan motor 33, final filtration cartridge 42 and ultimately to the environment through the exhaust port 44.

Figure 2:
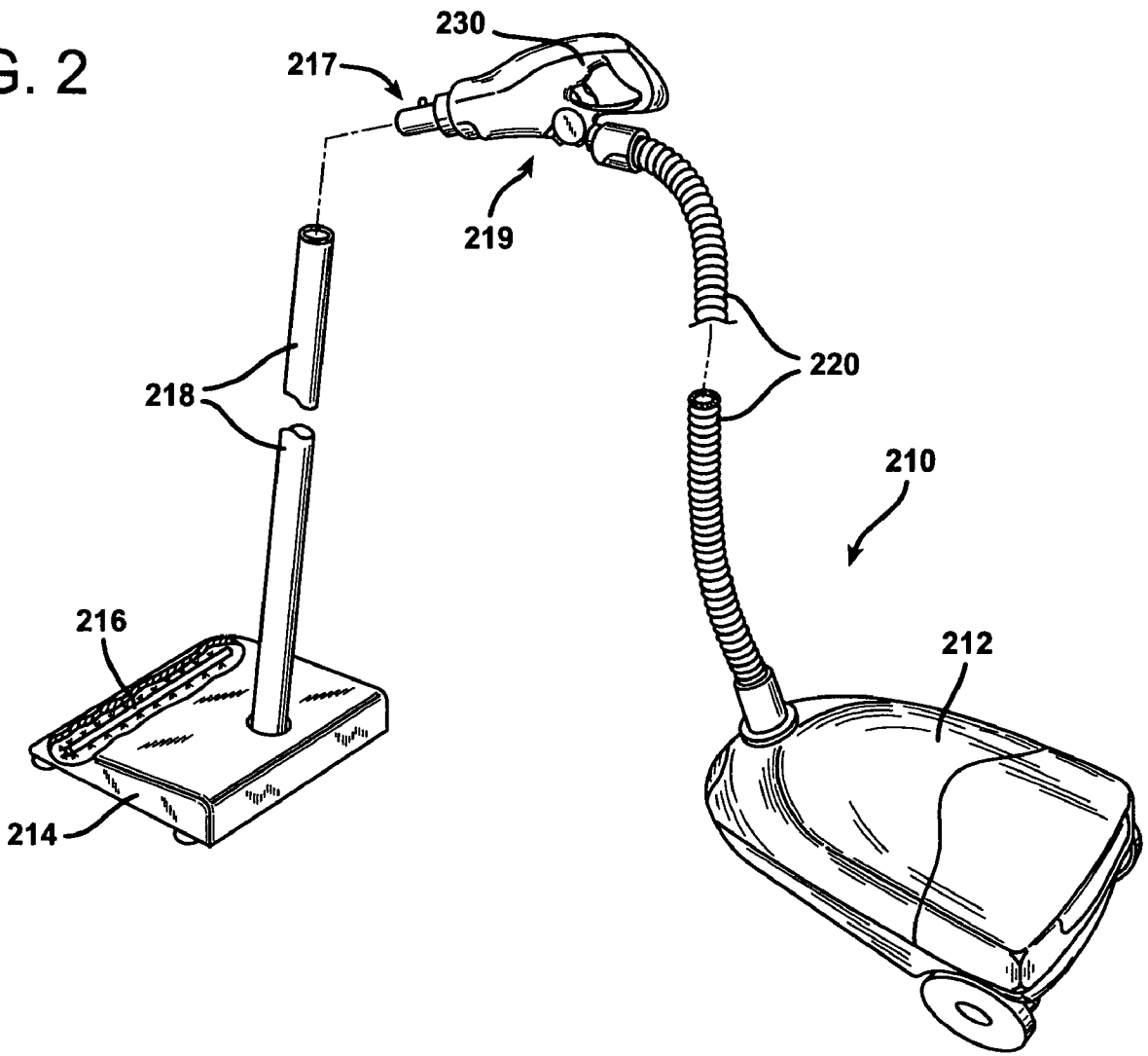
FIG. 2 is a perspective view of a floor care apparatus, in this instance a canister vacuum cleaner, constructed in accordance with the teachings of the present invention.

With reference to FIG. 2, a floor care apparatus of the present invention in this embodiment exemplifies a canister vacuum cleaner 210 comprised generally of a base assembly 212 and a nozzle assembly 214. Although not shown, the base assembly contains a suction fan motor that cooperates with an agitator 216 in the nozzle assembly for sucking up dirt and dust in a manner previously described. A wand 218 mechanically and fluidly connects to the nozzle assembly and facilitates the sucking up of dirt and dust. In various embodiments, it may comprise a unitary, telescopic or connecting section of pipe, such as an aluminum pipe. Near the base assembly, a hose 220, flexible for user manipulation, connects thereto and likewise facilitates the sucking up of dirt and dust. Finally, a handle 230 having ends 217, 219 connects mechanically and fluidly to both the wand 218 and the hose 220 and enables an airflow path between the nozzle assembly and the suction fan motor of the base assembly.

In either floor care apparatus embodiment, the cleaners have an agitator motor control circuit 310 for driving the agitator motor 340 at two or more speeds. In turn, the agitator motor drives the agitator of the cleaner at two or more speeds. In this manner, and upon user indication of a mode-of-operation preference (thereby indicating a speed preference) by manipulation of a switch, SW, the agitator cleans at a first speed of rotation for certain types of flooring and at a second speed for other types of flooring. Appreciating that since the agitator motor 340 (alternatively: motor 40, FIG. 11) is not the cleaner motor for creating a suction airflow, e.g., suction fan motor 33 (FIG. 1), this change in agitator speeds will not affect the suction power of the cleaner. It will, however, be able to reduce the speed of the agitator from full speed to some lesser speed thereby minimizing or preventing damage to certain flooring types.

Figure 4A:
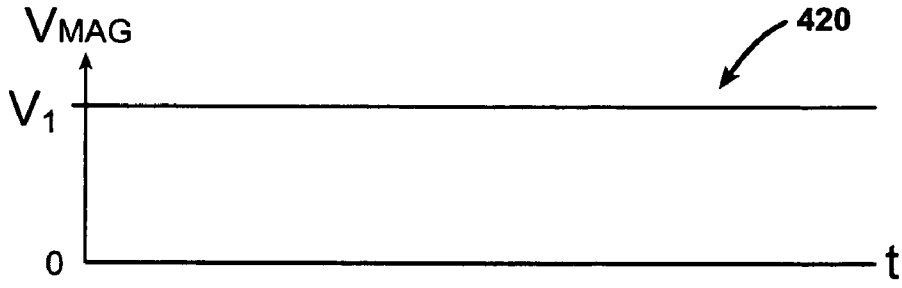
FIG. 4A is a graphical diagram of a substantially constant voltage signal for an agitator motor.
Figure 4B:
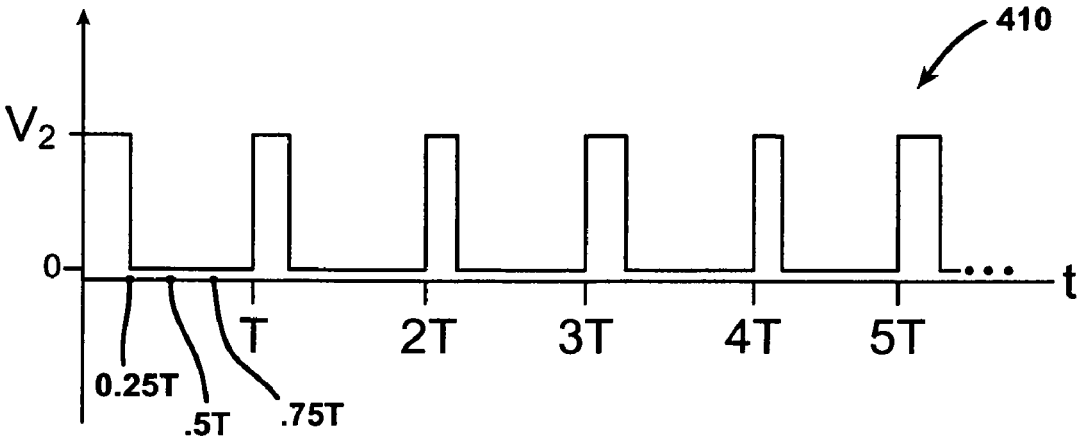
FIG. 4B is a graphical diagram of a fixed duty cycle signal for an agitator motor.

In a simplified illustration, the control circuit 310 includes a bridge rectifier 312, a timer 314 and a transistor, preferably a MOSFET, or other switch 316. A diode 318 exists in parallel with the agitator motor. An output of the timer turns the gate of the MOSFET on or off thereby pulsing, or not, the agitator motor tied between a power source and the MOSFET source. The bridge rectifier transforms the line voltage, e.g., 120 Vac, 60 Hz, into a dc voltage which serves as the power source for the agitator motor. During use, and responsive to the switch SW position, the control circuit 310 produces an output signal $V_{M_{AG}}$ across terminals 320, 322 having either a fixed duty cycle signal, having a substantially rectangular voltage waveform 410 (FIG. 4B), or a substantially constant voltage signal waveform 420 (FIG. 4A).

In one aspect, the fixed duty cycle is about 0.25 [on time/total on and off time] corresponding to a rectangular waveform with a substantially constant voltage value V2 that is on for a first quarter (time 0 to time 0.25T) of four quarters of the waveform period T. Thereafter, the waveform repeats for additional periods 2T, 3T, 4T, 5T, etc. In this manner, if the line voltage is 120 Vac, the agitator motor receives an average voltage value (in a dc equivalent voltage value downstream of the bridge rectifier) corresponding to about 0.25×120 or about 30 V. When the signal is a constant voltage value signal, the agitator motor control circuit produces an agitator motor voltage corresponding to V1 which, in turn, corresponds to about 100% of the line voltage (again this corresponds to a dc equivalent voltage downstream of the bridge rectifier). In another aspect, the fixed duty cycle is about 0.5 corresponding to a rectangular waveform with a substantially constant voltage value that is on for a first two quarters of four quarters of the waveform period. Thereafter, the waveform repeats for additional periods. Of course, 0.25 or 0.5 fixed duty cycle voltage waveforms can have variations in which of the quarters, or other divisions, of the waveform period are on and off. In still other aspects, the fixed duty cycle may be higher than 0.5 or less than 0.25 or between these two values. Ultimately, the agitator is either run at a voltage corresponding to about 100% of the line voltage or about 25% or 50% to enhance cleaning on various style floors. During 100%, or full speed, the agitator rotates at about 3000 to about 6000 rpm. More preferably, it rotates at about 3500 rpm. During other times, it rotates at about 800 to about 2000 rpm. More preferably, it rotates at about 1750 rpm, or half-speed. Skilled artisans will understand, however, the agitator rpm, the actual duty cycle of the pulsed or repeating rectangular voltage waveform output signal and the constant voltage level signal may vary according to manufacturer preference.

Figure 5:
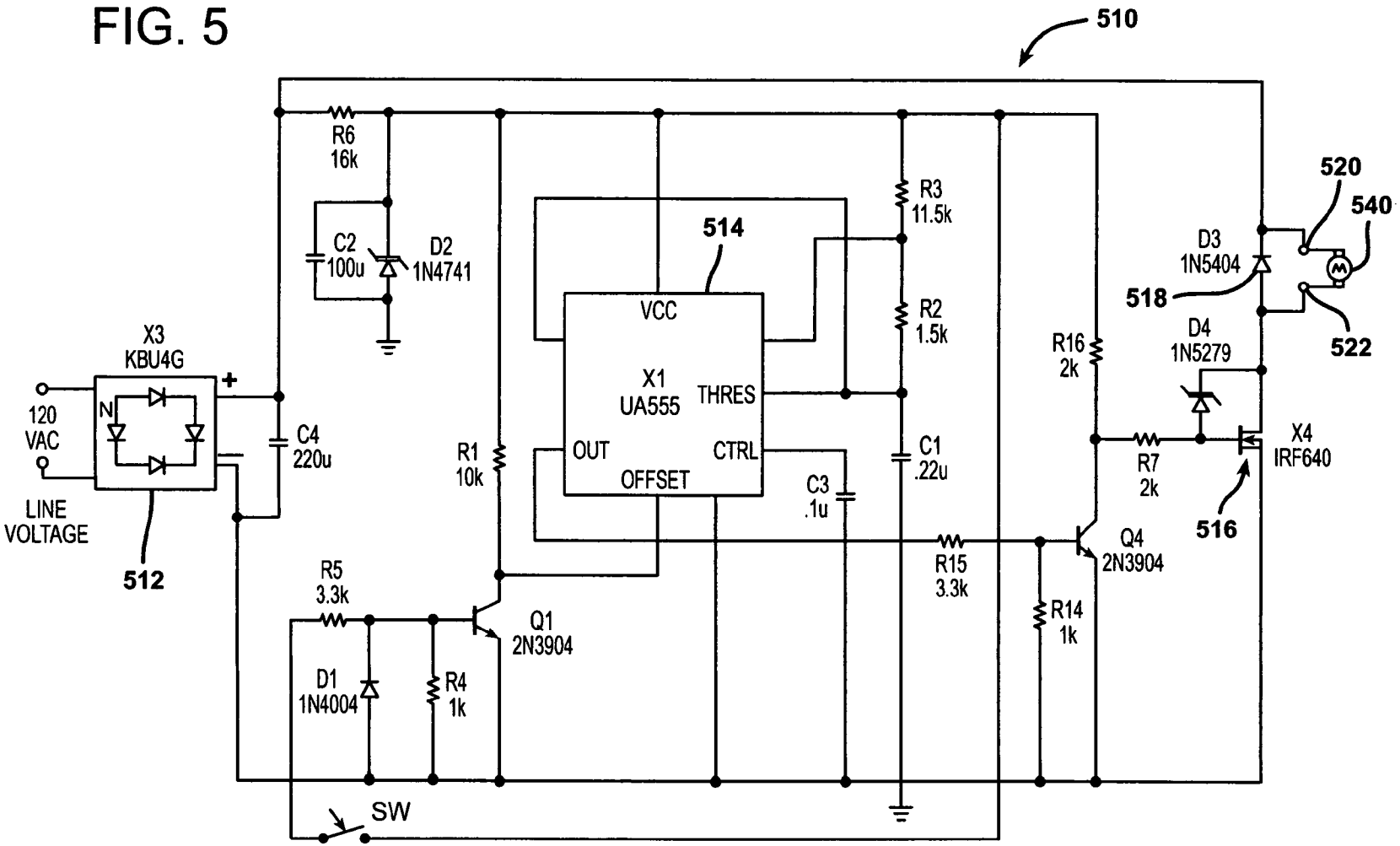
FIG. 5 is a more detailed circuit diagram of the agitator motor control circuit of FIG. 3.

With reference to FIG. 5, a more preferred agitator motor control circuit 510 includes various resistor, capacitor, diode and transistors for trimming a traditional 555 microchip timer. As a matter of reference numeral convention, however, like elements in FIGS. 3 and 5 have ones and tens digits of their reference numerals corresponding to one another. For example, the bridge rectifier in FIG. 3 has a reference numeral of 312 while in FIG. 5 it has a reference numeral of 512. The specific parts of control circuit 510 follow the entries of the following Table:

| PART | DESC. |
|---|---|
| R6 | 16 KΩ 1 watt resistor |
| R5, R15 | 3.3. KΩ 0.25 watt resistor |
| R4, R14 | 1.0 KΩ 0.25 watt resistor |
| R3 | 11.5 KΩ 0.25 watt resistor |
| R2 | 1.5 KΩ 0.25 watt resistor |
| R16, R7 | 2.0 KΩ 0.25 watt resistor |
| R1 | 10 KΩ 0.25 watt resistor |
| C2 | Capacitor 100 μf 35 V |
| C1, C3 | Capacitor 0.22 μf 25 V |
| C4 | Capacitor 220 μf 250 V |
| D2 | Zener 1N4741 |
| D1 | Diode 1N40004 |
| Q1, Q4 | 2N3904 Transistor |
| D4 | 1N5279 180 V Zener |
| Q2 | IRF 640 Transistor |
| U1 | LM555 Timer IC |
| D7 | IN5404 Diode |
| X3 | Bridge Rectifier |

Figure 6:
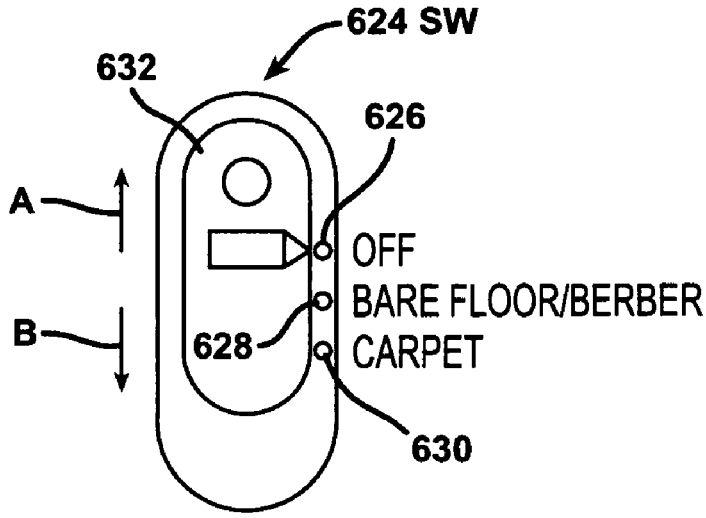
FIG. 6 is a planar diagram of a representative user operated switch for indicating a mode-of-operation preference thereby indicating a speed preference of the agitator.

In FIG. 6, a preferred control switch 624SW for placement on a cleaner handle 22 (FIG. 1), for example, includes an off position 626, a Barefloor/BERBER position 628 and a Carpet position 630. In such positions, the user indicates their mode-of-operation preference, thereby indicating agitator speed because the agitator motor control circuit will then drive the agitator motor to keep the agitator off, the agitator at about 3500 rpm or at about 1700 rpm, respectively. The switch has a thumb or finger slide 632 that moves in the direction of arrows A or B upon user manipulation.

Figure 7:
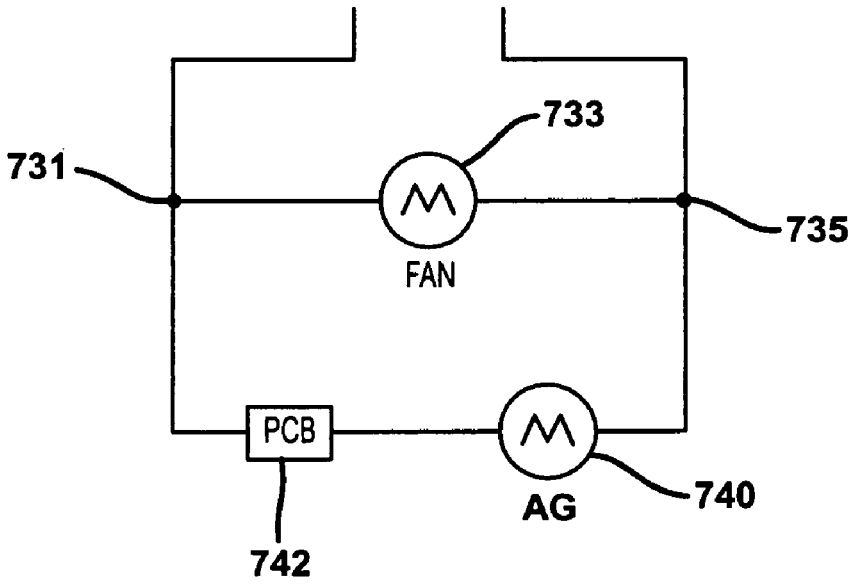
FIG. 7 is a circuit diagram of a floor care apparatus having separate suction fan and agitator motors.

In FIG. 7, a basic circuit schematic depicts the suction fan motor 733 in parallel with a printed circuit board 742 and the agitator motor 740 as between electrical terminals 731, 735. The printed circuit board preferably contains the agitator motor control circuit.

Figure 8A:
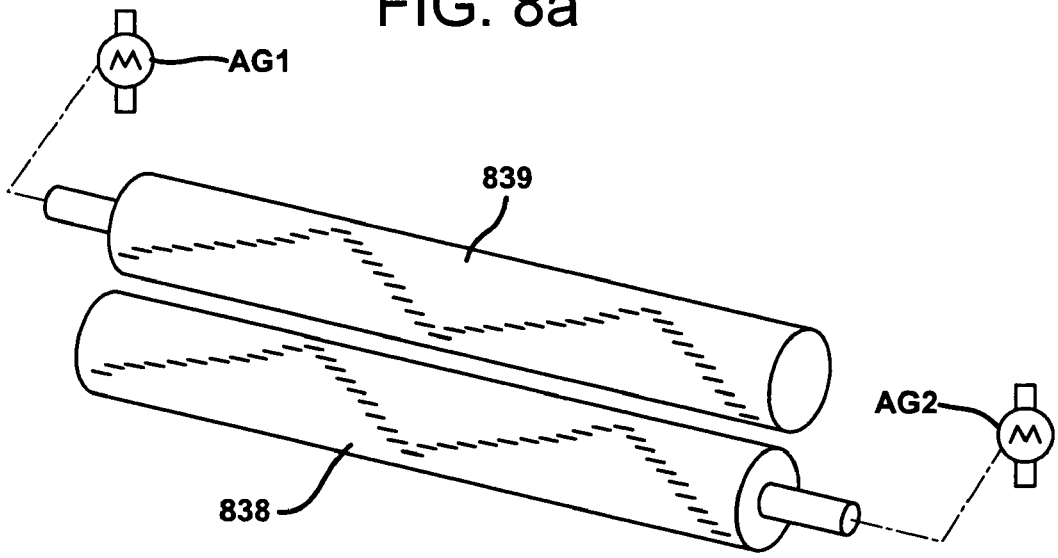
FIG. 8A is a diagram of an alternate embodiment of the present invention having a plurality of agitators each having a separate agitator motor.
Figure 8B:
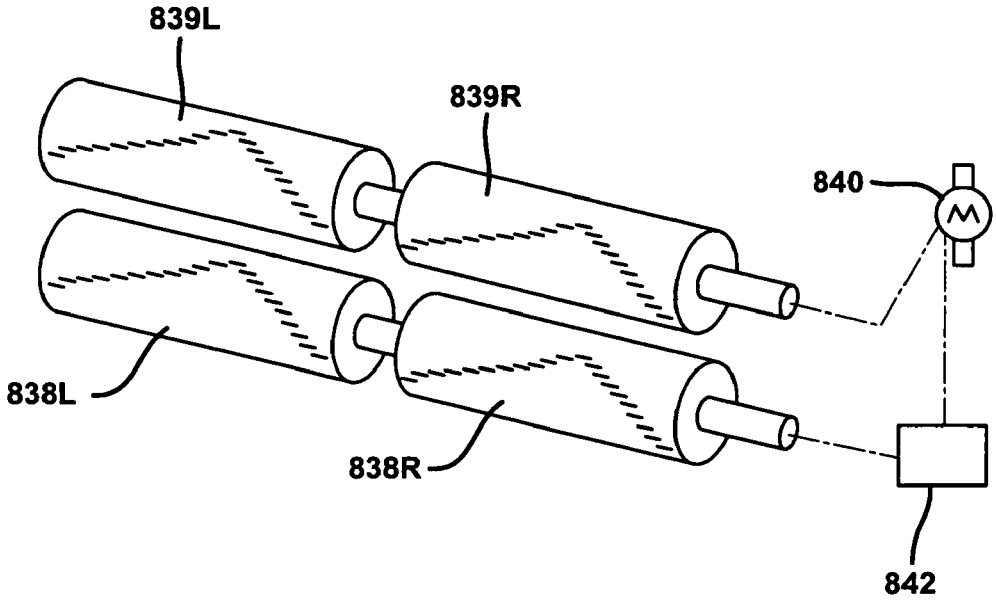
FIG. 8B is a diagram of an alternate embodiment of the present invention having a plurality of bifurcated agitators.
Figure 9:
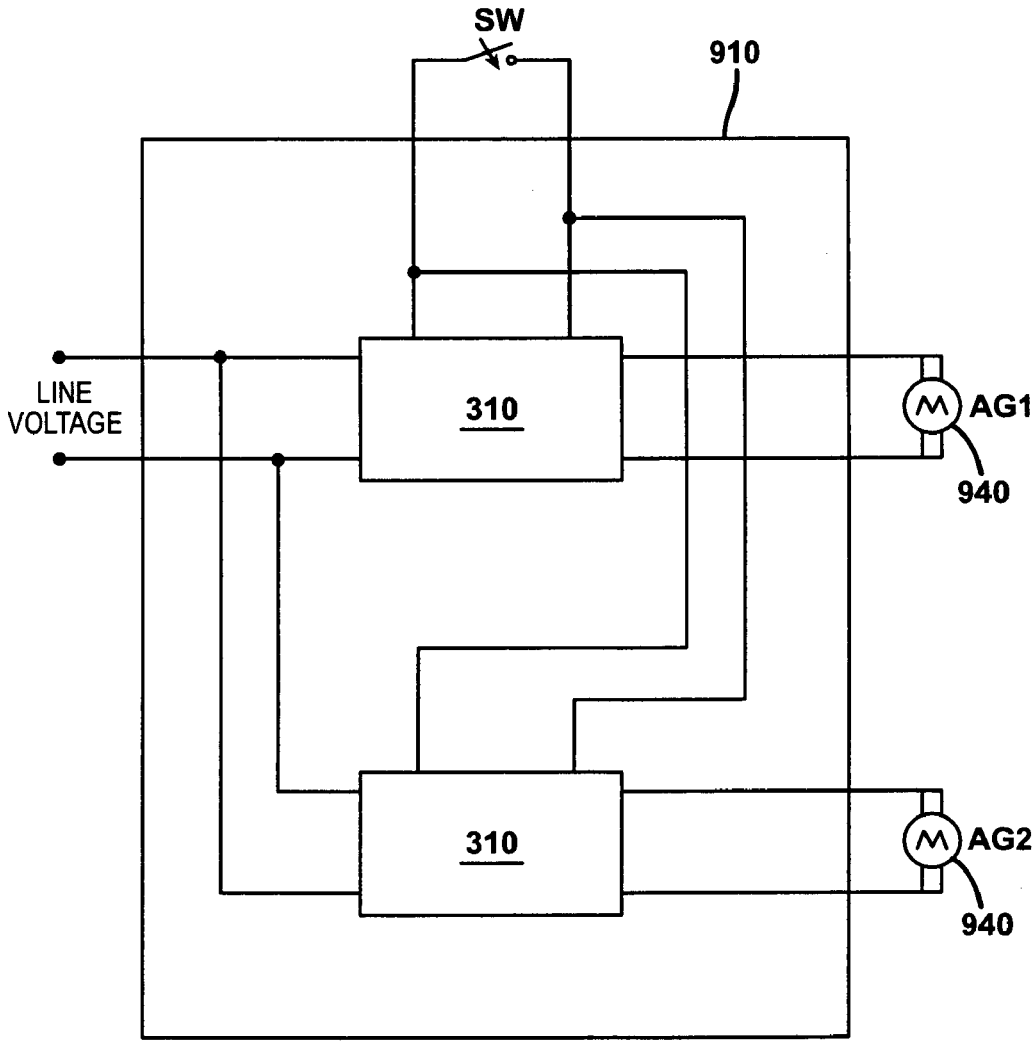
FIG. 9 is a circuit diagram of a representative embodiment of an agitator motor control circuit for use with a multiple agitator embodiment.
Figure 10:
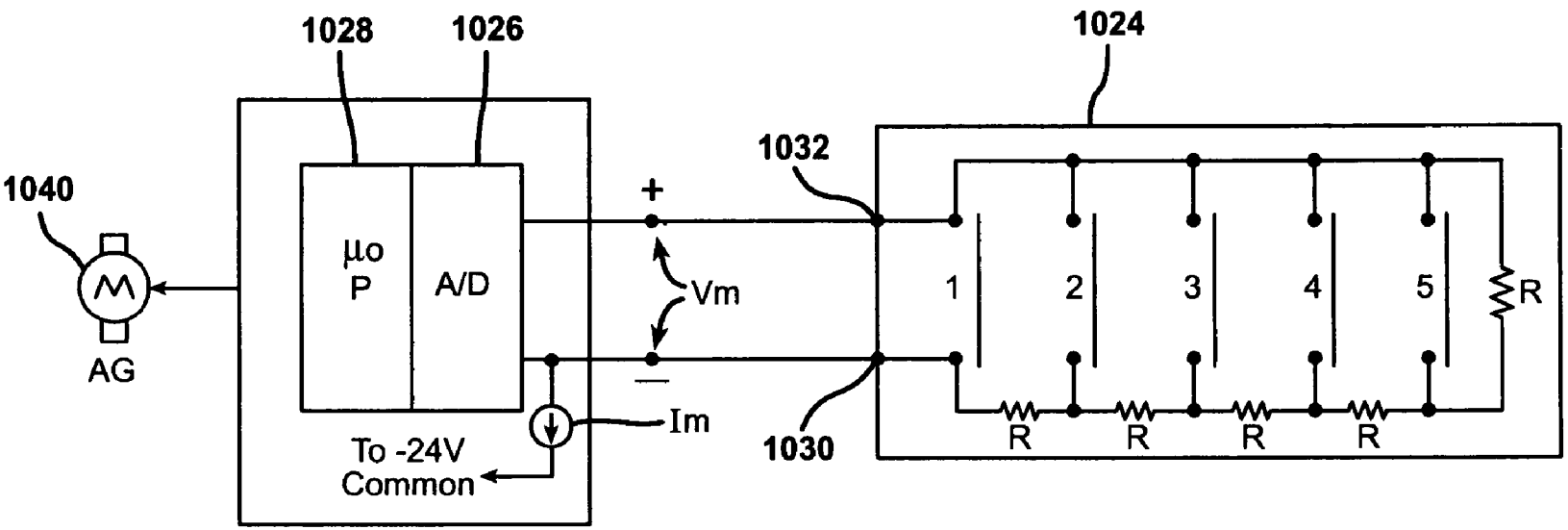
FIG. 10 is a circuit diagram of a user operated switch for indicating a mode-of-operation preference thereby indicating a speed preference of an agitator motor.

Appreciating that many modem day vacuum cleaners house multiple agitators in a single nozzle assembly, the present invention further contemplates operating multiple agitators at various speeds. In FIG. 8A, first and second agitators 838, 839 each have their own dedicated agitator motor AG2 or AG1, respectively. In FIG. 8B, the agitators 838, 839 have bifurcated left (L) and right (R) halves driven with a single agitator motor 840. To accomplish separate speed control for each agitator, a gear mechanism 842 may exist in the control line between the agitator motor and one of the agitators. Of course, the motor and gearing of FIG. 8B could replace the multiple motor embodiment of FIG. 8A or vice versa. Some embodiments of the speed control include rotating or running two agitators with the same speed, in the same directions; same speed, different directions; different speeds, same direction; or different speeds, different directions.

Figure 3:
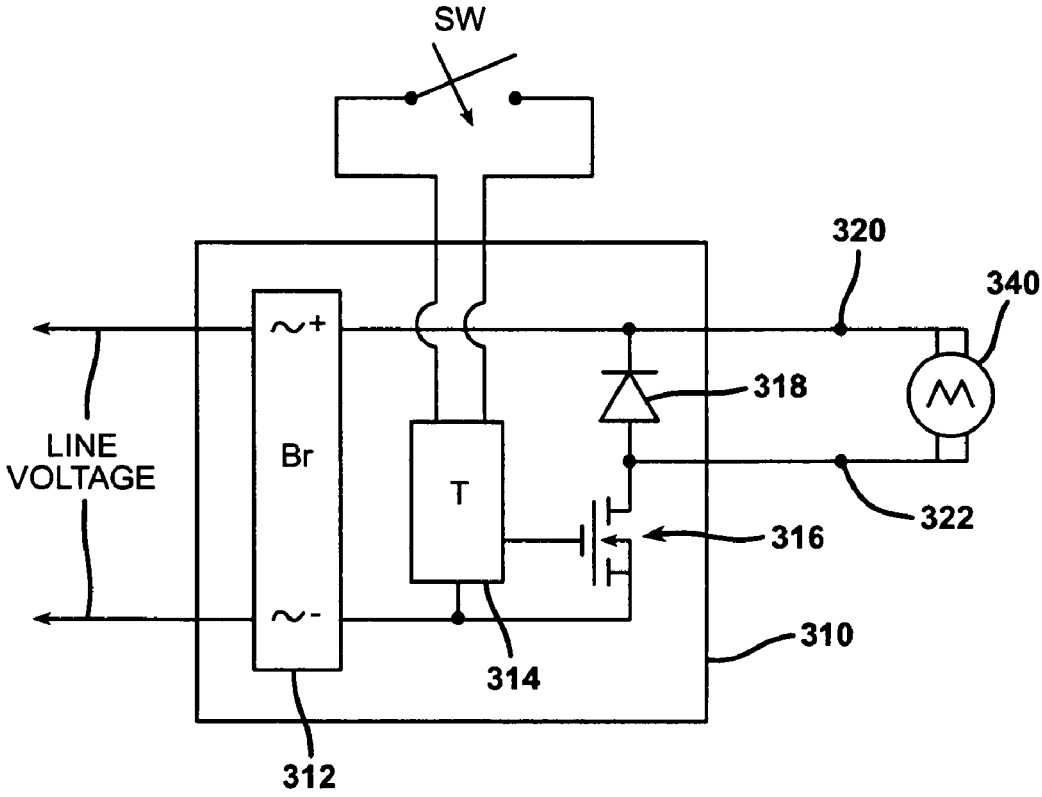
FIG. 3 is a circuit diagram of a representative embodiment of an agitator motor control circuit in accordance with the present invention.

In a simple circuit, a user can control multiple motor 940 AG1, 940 AG2 embodiments of multiple-speed agitators by creating an agitator motor control circuit 910 having parallel circuitry for the agitator motor control circuit 310 of FIG. 3.

In still another embodiment, the agitator motor control circuit resides as hardware or software components relative to a microprocessor 1028 and an output of which controls the agitator motor 1040 as previously described. A user operated switch 1024, for indicating mode-of-operation preference thereby indicating agitator speed, embodies a resistor network having a plurality of equally valued resistors R symmetrically connected about a series of user-selectable push buttons numbered 1-5. In this manner, upon selection of a single push button (which, in one aspect, may be a momentary-on or permanently-on micro switch or other switch), a particular voltage value $V_m$ appears at the input terminals of an analog to digital (A/D) converter 1026, in turn, providing input to the microprocessor. Since off-the-shelf A/D components have specified input voltage ranges, vacuum cleaner manufacturers can pick resistor values to make $V_m$ appear within a proper voltage range and the particular user selected push button can be inferred electrically. Mathematically, $V_m=R_{total}\times I_m$, where $R_{total}$ is an equivalent resistance value for switch 1024 appearing at terminals 1030, 1032 and $I_m$ is a fixed current source connected between the negative $V_m$ terminal and −24V common.

In one preferred embodiment: (1) $V_m$ is 0.416v for an acceptable A/D input voltage range of 0-0.833 v and this corresponds to user depression of push button number 1; operationally, the suction fan motor is off (skilled artisans will appreciate that suction fan motor control is a well known practice); (2) $V_m$ is 1.25v for an acceptable A/D input voltage range of 0.833-1.66v and this corresponds to depression of push button number 2; operationally, the suction fan motor is low; (3) $V_m$ is 2.08v for an acceptable A/D input voltage range of 1.66-2.499v and this corresponds to depression of push button number 3; operationally, the suction fan motor is medium; (4) $V_m$ is 2.92v for an acceptable A/D input voltage range of 2.499-3.33v and this corresponds to depression of push button number 4; operationally, the suction fan motor is high; (5) $V_m$ is 3.75v for an acceptable A/D input voltage range of 3.33-4.16v and this corresponds to depression of push button number 5; operationally, the suction fan motor is high and the agitator is off; and (6) $V_m$ is 4.58v for an acceptable A/D input voltage range of 4.16-4.999v and this corresponds to no depression of any push button; operationally, no motors work.

The foregoing was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

The invention claimed is:

1. A floor care apparatus, comprising:

a nozzle assembly;

an agitator in said nozzle assembly;

a motor coupled to said agitator for driving said agitator at two or more speeds;

a switch with at least two positions for a user to indicate a mode-of-operation preference; and an agitator motor control circuit responsive to said switch and coupled to supply at least two signals to said motor, one of said two signals having a fixed duty cycle of less than 1.0, the other of said two signals being substantially constant.

2. The floor care apparatus of claim 1, wherein said fixed duty cycle is one of about 0.25 and about 0.5.

3. The floor care apparatus of claim 1, wherein said one of said two signals includes a waveform, having a period, with a substantially constant voltage value that is on for only one or two of four quarters of said period, said waveform repeating for additional periods.

4. The floor care apparatus of claim 1, further including a suction fan motor separate from said motor coupled to said agitator.

5. The floor care apparatus of claim 1, wherein operation of said switch changes resistor connections such that a voltage input to an analog to digital converter falls within a specified input range for said analog to digital converter.

6. The floor care apparatus of claim 5, wherein a total resistance value of said resistor connections multiplied by a current value of a fixed current source determines said voltage input.

7. A floor care apparatus, comprising:

a suction fan motor for providing a suction airflow during use:

a nozzle assembly in fluid communication with the suction fan motor, an airflow path existing from said nozzle assembly to said suction fan motor;

a first and second agitator in said nozzle assembly;

at least one motor, separate from the suction fan motor, for driving at least one of the first and second agitator;

an agitator motor control circuit to drive said first agitator at a first and second speed and said second agitator at a first and second speed, said first and second speeds of each of said first and second agitators being one of the same speed and a different speed.

8. The floor care apparatus of claim 7, further including a first and second motor for driving said first and second agitators.

9. The floor care apparatus of claim 8 further including a gear mechanism between one of said first motor and said first agitator and said second motor and said second agitator not found between the other of said first motor and said first agitator and said second motor and said second agitator.

10. The floor care apparatus of claim 7, further including a switch with at least two positions for a user to indicate a mode-of-operation preference thereby indicating a preference of said first and second speeds, said agitator motor control circuit responsive to said switch.

11. The floor care apparatus of claim 10, wherein an output of said agitator motor control circuit is one of a signal having a fixed duty cycle of less than 1.0 and a signal being substantially constant.

12. The floor care apparatus of claim 11, wherein said fixed duty cycle is one of about 0.25 and about 0.5.

13. The floor care apparatus of claim 11, wherein said one of said signal having said fixed duty cycle includes a waveform, having a period, with a substantially constant voltage value that is on for only one or two of four quarters of said period, said waveform repeating for additional periods.

14. The floor care apparatus of claim 7, further including a switch with at least two positions for a user to indicate a mode-of-operation preference thereby indicating a preference of said first and second speeds, said agitator motor control circuit responsive to said switch wherein operation of said switch changes resistor connections such that a voltage input to an analog to digital converter falls within a specified input range for said analog to digital converter.

15. A vacuum cleaner, comprising:

a suction fan motor for providing a suction airflow during use;

a nozzle assembly in fluid communication with the suction fan motor, an airflow path existing from said nozzle assembly to said suction fan motor;

at least one agitator in said nozzle assembly;

an agitator motor coupled to said at least one agitator for driving said agitator at two or more speeds;

a switch with at least two positions for a user to indicate a mode-of-operation preference thereby indicating a preference of said two or more speeds; and an agitator motor control circuit responsive to said switch and coupled to supply at least two signals to said agitator motor in accordance with said speed preference wherein one of the two signals has a fixed duty cycle of less than 1.0.

16. The vacuum cleaner of claim 15, wherein said agitator motor does not exist in said airflow path.

17. The vacuum cleaner of claim 15, wherein one of said two signals has a substantially repeating rectangular voltage waveform with a fixed duty cycle of about 0.25 or 0.5.

18. The vacuum cleaner of claim 15, wherein the other of said two signals is a substantially constant voltage level.

19. The vacuum cleaner of claim 15, further including a second motor for driving a second agitator.

20. The vacuum cleaner of claim 15, wherein said one of said two signals includes a waveform having a period with a substantially constant voltage value that is on for only one or two of four quarters of said period, said waveform repeating for additional periods.

21. The floor care apparatus of claim 15, wherein operation of said switch changes resistor connections in a circuit such that a voltage input to an analog to digital converter falls within a specified input range for said analog to digital converter.

22. The floor care apparatus of claim 21, wherein a total resistance value of said resistor connections multiplied by a current value of a fixed current source determines a voltage value of said voltage input.

23. A vacuum cleaner, comprising:

a suction fan motor for providing a suction airflow during use;

a nozzle assembly in fluid communication with the suction fan motor for sucking up dirt and debris from a surface to be cleaned, an airflow path existing from said nozzle assembly to said suction fan motor;

at least one agitator in said nozzle assembly;

an agitator motor coupled to said at least one agitator for driving said agitator at two or more speeds, said agitator motor not existing in said airflow path;

a switch with at least two positions for a user to indicate a mode-of-operation preference thereby indicating a speed preference of said two or more speeds; and an agitator motor control circuit responsive to said switch and coupled to supply at least two signals to said agitator motor in accordance with said speed preference, wherein one of said two signals has a substantially repeating rectangular voltage waveform with a fixed duty cycle and the other of said two signals has a substantially constant voltage level.

24. A floor care apparatus, comprising:

a nozzle assembly;

a first and second agitator in said nozzle assembly;

an agitator motor control circuit to drive said first agitator at a first and second speed and said second agitator at a first and second speed, said first and second speeds of each of said first and second agitators being one of the same speed and a different speed, wherein an output of said agitator motor control circuit is one of a signal having a fixed duty cycle of less than 1.0 and a signal being substantially constant.

25. The floor care apparatus of claim 24, wherein said fixed duty cycle is one of about 0.25 and about 0.5.

26. The floor care apparatus of claim 24, wherein said one of said signal having said fixed duty cycle includes a waveform, having a period, with a substantially constant voltage value that is on for only one or two of four quarters of said period, said waveform repeating for additional periods.

* * * * *

UNITED STATES PATENT AND TRADEMARK OFFICE

CERTIFICATE OF CORRECTION

PATENT NO. : 7,251,858 B2
APPLICATION NO. :10/764401
DATED : August 7, 2007
INVENTOR(S) : J. Erik Hitzelberger and George N. Woolcott It is certified that error appears in the above-identified patent and that said Letters Patent is hereby corrected as shown below:

In the drawings, Delete Fig. 1 and replace Figure 1 with the following: as attached Signed and Sealed this Thirteenth Day of November, 2007

JON W. DUDAS
*Director of the United States Patent and Trademark Office*